US011475780B2

(12) United States Patent
Håkansson

(10) Patent No.: US 11,475,780 B2
(45) Date of Patent: Oct. 18, 2022

(54) AIRPORT STAND ARRANGEMENT AND METHOD

(71) Applicant: ADB Safegate Sweden AB, Malmö (SE)

(72) Inventor: Peter Håkansson, Malmö (SE)

(73) Assignee: ADB SAFEGATE SWEDEN AB, Malmö (SE)

( * ) Notice: Subject to any disclaimer, the term of this patent is extended or adjusted under 35 U.S.C. 154(b) by 0 days.

(21) Appl. No.: 17/622,863

(22) PCT Filed: Jun. 25, 2020

(86) PCT No.: PCT/EP2020/067811
§ 371 (c)(1),
(2) Date: Dec. 27, 2021

(87) PCT Pub. No.: WO2020/260452
PCT Pub. Date: Dec. 30, 2020

(65) Prior Publication Data

US 2022/0246049 A1 Aug. 4, 2022

(30) Foreign Application Priority Data

Jun. 28, 2019 (EP) ..... 19183349

(51) Int. Cl.
*G08G 5/00* (2006.01)
*G08G 5/06* (2006.01)

(52) U.S. Cl.
CPC ..... *G08G 5/065* (2013.01); *G08G 5/0026* (2013.01)

(58) Field of Classification Search
USPC ..... 340/958
See application file for complete search history.

(56) References Cited

U.S. PATENT DOCUMENTS 7,772,992 B2 * 8/2010 Fetzmann ..... G05D 1/0083 340/961
11,053,023 B2 * 7/2021 Berkmo ..... G08G 5/0026
(Continued)

FOREIGN PATENT DOCUMENTS

CN 103700288 A 4/2014
KR 10-0542466 B1 1/2006

OTHER PUBLICATIONS

International Search Report and Written Opinion dated Sep. 28, 2020, received for PCT Application PCT/EP2020/067811, Filed on Jun. 25, 2020, 12 pages.
(Continued)

*Primary Examiner* — Brent Swarthout
(74) *Attorney, Agent, or Firm* — Xsensus LLP

(57) ABSTRACT

An airport stand arrangement includes a remote sensing system configured to detect an aircraft within a sensing area, wherein the sensing area includes a stand area, and a controller configured to: determining, based on sensor data received from said remote sensing system, one or more estimated exterior surface positions on the aircraft, wherein each estimated exterior surface position is an estimated position of an associated real exterior surface position on the aircraft, wherein said real exterior surface position defines a limit of an extension of said aircraft in the sensing area, compare said one or more estimated exterior surface positions with one or more coordinates of the stand area to determine if at least one from said one or more estimated exterior surface positions is outside of said stand area, and in response to at least one from said one or more estimated exterior surface positions being determined to be outside of said stand area: output an aircraft parking alert signal.

12 Claims, 4 Drawing Sheets

(56) References Cited

U.S. PATENT DOCUMENTS

| | | | | |
|---|---|---|---|---|
| 2003/0060998 | A1 | 3/2003 | Millgard | |
| 2008/0062011 | A1 | 3/2008 | Butler et al. | |
| 2010/0219988 | A1 | 9/2010 | Griffith | |
| 2013/0289867 | A1 | 10/2013 | Thelander | |
| 2015/0194059 | A1 | 7/2015 | Starr et al. | |
| 2017/0263139 | A1 | 9/2017 | Deng et al. | |
| 2019/0106223 | A1 | 4/2019 | Hakansson | |
| 2022/0036750 | A1* | 2/2022 | Poojary | G01S 13/867 |
| 2022/0066025 | A1* | 3/2022 | Berkmo | G08G 5/065 |

OTHER PUBLICATIONS

International Preliminary Report on Patentability (Chapter II) dated Oct. 21, 2021, date of demand, Apr. 27, 2021, 24 pages.

* cited by examiner

AIRPORT STAND ARRANGEMENT AND METHOD

CROSS-REFERENCE TO RELATED APPLICATIONS

The present application is based on PCT filing PCT/EP2020/067811, filed Jun. 25, 2020, which claims priority to EP 19183349.0, filed Jun. 28, 2019, the entire contents of each are incorporated herein by reference.

FIELD OF THE INVENTION

The present invention relates to an airport stand arrangement and method. More specifically, the disclosure relates to an airport stand arrangement and method for determining if an aircraft is completely within a predefined stand area.

BACKGROUND ART

Airport stand arrangements of the kind disclosed herein are typically used to monitor aircrafts in, or in a vicinity of, a stand area. Some airport stand arrangements of this kind have means and function for automatic docking of aircrafts. Such airport stand arrangements are sometimes referred to as aircraft docking systems.

A problem with airport stand arrangements of the art is that they are less accurate in determining if an aircraft has indeed parked at the stand in a safe way. Often, current airport stand arrangements will convey information to personnel and/or systems at the airport that the aircraft has parked safely when in reality the aircraft may be parked in an unsafe way in the stand. Such an unsafe parking may increase the risk of accidents at the stand. For example, other aircrafts and/or airport vehicles passing or operating within the stand may collide with the unsafely parked aircraft.

Thus, although present airport stand arrangement are capable of providing efficient and safe docking, and/or of providing monitoring of the stand area in general, there is still a need in the art for an improved airport stand arrangement.

SUMMARY

It is an object to mitigate, alleviate or eliminate the above-identified deficiency in the art singly or in any combination and solve at least the above mentioned problem. According to a first aspect there is provided an airport stand arrangement comprising:

a remote sensing system configured to detect an aircraft within a sensing area, wherein said sensing area includes a stand area of a stand, and a controller configured to:

determine, based on sensor data received from said remote sensing system, one or more estimated exterior surface positions on the aircraft, wherein each estimated exterior surface position is an estimated position of an associated real exterior surface position on the aircraft, wherein said real exterior surface position defines a limit of an extension of said aircraft in the sensing area, compare said one or more estimated exterior surface positions with one or more coordinates of the stand area to determine if at least one from said one or more estimated exterior surface positions is outside of said stand area, and in response to at least one from said one or more estimated exterior surface positions being determined to be outside of said stand area:

output an aircraft parking alert signal.

The term "remote sensing system" should be construed as a detection system capable of detecting properties of an object from a remote location. In the framework of the present disclosure, the term remote should not be construed as limited to very long distances, such as the term is conventionally used for satellite remote sensing. For the interpretation of the appended claims, "remote sensing" should be construed as sensing within a typical stand area, i.e. an area of typical dimensions around 20-50 meters from the remote sensing system, wherein sensing is performed without actually being in contact with the object (i.e. remote sensing).

The term "sensing data" should be construed as data extracted from detector readings of the remote sensing system. In case an object is present in the sensing area, and said object is being sensed, sensing data will pertain to properties of that object.

The term "sensing area" should be construed as a geometrical area at ground level at the stand at which the remote sensing area is able to accurately detect and sense an object, such as an aircraft.

The term "exterior surface position" (on the aircraft) should be construed as positions defined along an exterior of the aircraft marking the maximum boundary of the aircraft within the stand area. Thus, the exterior surface positions pertain to a two-dimensional projection of the aircraft in a plane parallel with the stand area (i.e. essentially a horizontal plane). The "estimated exterior surface positions" are estimated positions aiming to represent the true, or real, exterior surface positions which are defined along an exterior surface of the aircraft. Thus, an estimated exterior surface position may deviate from the real exterior surface position. From this follows that an estimated exterior surface position may very well be located within the boundaries of the aircraft, or, alternatively, at a distance from the aircraft exterior surface, depending on how the estimated position deviates from the true position.

The term "stand area" should be construed as an area within which the aircraft is allowed to reside when parking safely at the stand. The stand area is enclosed by the sensing area and the remote sensing system is thus capable of monitoring the stand area in its entirety. The stand area is typically smaller than the maximum physical area available at the stand. The maximum physical area may encompass areas at which the aircraft is not allowed to be located for safety reasons, and/or because other equipment is located there. The stand area is defined in terms of coordinates, i.e. spatial coordinates. In the context of the present disclosure, said coordinates are two-dimensional coordinates defining the position of the stand area with respect to the surrounding areas, i.e. the rest of the maximum physical areas available at the stand, and/or further areas connecting thereto, such as e.g. an airport taxiway.

The controller may be configured to determine said one or more estimated exterior surface positions on the aircraft by extracting positions of sensed parts of the aircraft from said sensor data, assigning said extracted positons as estimated exterior surface positions. This is a direct approach: The sensor system essentially measures the estimated exterior surface positions on the aircraft directly.

Alternatively, or additionally, the controller may be configured to determine said one or more estimated exterior surface positions on the aircraft by extracting positions of sensed areas of the aircraft, and estimate said one or more estimated exterior surface positions on the aircraft by determining, based on said extracted positions of sensed areas of the aircraft, an aircraft extension at the stand. This is an indirect approach: The sensor system does not directly measure the estimated exterior surface positions on the aircraft. Instead these are inferred by the controller based on the sensor data available. This will be further discussed in what follows.

The airport stand arrangement may be advantageous as it allows for determining the geometrical constraints of all parts of the aircraft in relation to the stand, and monitoring whether the aircraft is located within an allowed area of the stand (i.e. the stand area) or not. In case one or more parts of the aircraft is determined not to be within the stand area, the arrangement is configured to warn airport personnel and/or other systems at the airport that the aircraft is not parked fully within the stand. This warning provides a mean for avoiding accidents at or in a vicinity of the stand. One example of such accidents is where a taxying aircraft aiming to pass a stand area at which another aircraft is parked, hits the tail of the parked aircraft with its wing tip. In the example, the collision occurs as the aircraft parked at the stand is not parked in a safe way. For example, the aircraft at the stand may have stopped some meters before the intended stop position at the stand. As an alternative example, the aircraft at the stand may be of an aircraft type different from the aircraft type expected at the stand. In both cases, the tail portion of the aircraft at the stand may be protruding out from the stand area into adjacent areas, such as e.g. the taxiway at which the passing aircraft is traveling. Furthermore, aircrafts parked, or maneuvering in neighboring stands may also be involved in accidents. For example, if the aircraft at the stand is parked somewhat too close to the neighboring stand, an aircraft maneuvering into, or out from said neighboring stand may collide with the parked aircraft. Typically, such accidents will involve the wing tips of the aircrafts. As aircrafts are large and, due to the wings, physically extended along different directions, it is difficult, if not impossible, for the pilot of the taxying aircraft and/or the pilot of the aircraft maneuvering in the neighboring stand to assess if he/she will be able to pass the aircraft parked at the stand without a collision.

The airport stand arrangement may consist of several interconnected units, wherein each unit may be disposed at different positions at, or around the gate area. However, the airport stand arrangement is disposed at the stand and is not configured to detect aircrafts at other parts of the airport, such as e.g. taxi lines (except for parts of a taxi line being in close vicinity of the stand area), or the runways.

According to some embodiments, said remote sensing system includes one or more from: a radar-based system, a laser-based system, and an imaging system.

The remote sensing system may comprise a radar-based system based on detection of microwave electromagnetic radiation. Such systems emit continuous or pulsed radar signals towards a target and capture and detect radar pulses backscattered from the target. The radar system may comprise a radar sensor of semi-conductor type. For example, the radar sensor may be of the kind used within the automotive industry. The radar sensor may operate at 77 GHz.

The remote sensing system may, alternatively or additionally, comprise a laser-based system based on detection of optical electromagnetic radiation. Such systems emit continuous or pulsed laser radiation towards a target and capture and detect laser radiation backscattered from the target. The laser-based system may comprise beam deflecting means for providing scanning capabilities. Such beam deflecting means may be e.g. a scanning mirror arrangement.

The remote sensing system may, alternatively or additionally, comprise a camera sensitive to optical or infrared radiation. The imaging system may be used to capture the emission of natural radiation from the target. However, it is also conceivable that the camera is used to capture radiation emitted from the target as a result from the laser-based system. Such radiation may be scattered or reflected laser radiation, fluorescence, phosphorescence and the like.

According to some embodiments, the airport stand arrangement further comprises a display, and wherein the airport stand arrangement is further configured, based on data from said remote sensing system, to detect and track the aircraft for parking at a parking position within said stand area, and configured, based on said detection and tracking of the aircraft, to provide pilot maneuvering guidance information on said display for aiding a pilot of the aircraft in maneuvering the aircraft towards said parking position.

This implies that the airport stand arrangement may be an aircraft docking system, or, at least, that the airport stand arrangement may have aircraft docking functionality.

It is however, conceivable that the airport stand arrangement is a separate arrangement at the stand. Such an airport stand arrangement may use its own remote sensing system, independent from any remote sensing systems of potential docking systems co-existing at the stand. Such airport stand arrangement may be configured to communicate with aircraft docking system at the stand. Alternatively, or additionally, such aircraft docking systems may be configured to communicate directly with a system of the airport, such as e.g. an airport operational database (AODB).

According to some embodiments, the controller being configured to determine one or more estimated exterior surface positions on the aircraft, comprises:

the controller being configured to:

identify one or more characteristic features of the aircraft, determine, for each characteristic feature of said one or more characteristic features, a respective characteristic feature position, so as to define, on the aircraft, one or more characteristic feature positions, receive aircraft dimension data pertaining to the aircraft, or to an aircraft which is expected to arrive at the stand, and calculate said one or more estimated exterior surface positions on the aircraft based on said one or more characteristic feature positions and said aircraft dimension data.

The term "characteristic feature of the aircraft" should be construed as a physical feature of the aircraft which may be sensed by the remote sensing system. Such characteristic features may be the nose portion of the aircraft, the aircraft engines etc. Each respective characteristic feature position marks the position at which the corresponding characteristic feature is located. If the characteristic feature extends over a large area or volume, the characteristic feature position may be defined using just one coordinate pair e.g. defining a center part of the extended area/volume covered by the feature. It is however also conceivable that more than one coordinate pair is used to mark the characteristic feature.

The term "aircraft dimension data" should be construed as any data which includes dimensions of aircrafts. Aircraft dimension data may pertain to a specific aircraft, a specific aircraft type and/or model, or to multiple aircrafts and/or aircraft types and/or models. Dimension data may typically be aircraft length, wing span, height, wing area, distance between engines, wheelbase etc.

By identifying characteristic features and using the positions thereof, a reference position may be determined for the aircraft in the sensing area. The reference position may serve as a first piece of information needed in order to determine coordinates defining the extension of the aircraft within the sensing area. A second piece of information may be provided by the received aircraft dimension data. If a reference position is known, aircraft dimension data may be used to determine further coordinates which together define the extension of the aircraft body within the sensing area. An aircraft alignment in relation to the sensing area has to be determined, estimated, or assumed. This will be further discussed later.

The aircraft dimension data may pertain to the actual aircraft in the stand. As known in the art, aircraft type and/or model may be identified e.g. by the airport stand arrangement itself or, alternatively, by other systems. However, the aircraft dimension data may alternatively pertain to an aircraft expected to arrive at the stand. The aircraft dimension data may be received from an airport dimension database. Such a database may include airport dimension data for a plurality of aircraft types and/or models. An airport dimension database may be a part of an airport operational database, but may alternatively be part of a separate database. The airport dimension database may be part of an aircraft characteristics database.

The airport stand arrangement may determine the aircraft type and/or model by using the identified characteristic features of the aircraft and compare these with aircraft dimension data. Typically, more than one characteristic feature is identified. Thus, according to some embodiments, said one or more characteristic features of the aircraft comprises two or more characteristic features of the aircraft, and said one or more characteristic feature positions comprises two or more characteristic feature positions.

According to some embodiments, the controller is then configured to compare said two or more characteristic feature positions with an aircraft dimension database which includes aircraft dimension data for a plurality of aircraft types and/or models. In response to a match being found between said two or more characteristic feature positions and specific aircraft dimension data from the aircraft dimension data in the database, the controller may be configured to determine said one or more estimated exterior surface positions on the aircraft based on said two or more characteristic feature positions and said specific aircraft dimension data.

According to alternative embodiments, the one or more estimated exterior surface positions on the aircraft is determined based on said one or more characteristic feature positions and aircraft dimension data pertaining to an aircraft which is expected to arrive at the stand. The controller may receive said dimensions directly, for example from another system at the airport e.g. an airport operational database. Alternatively, the controller may receive the aircraft type and/or model of the aircraft which is expected to arrive at the stand, whereby the controller has to query the aircraft dimension database, which includes aircraft dimension data for a plurality of aircraft types and/or models, to obtain said dimensions therefrom.

According to some embodiments, a specific characteristic feature of said one or more characteristic features of the aircraft is a nose portion of the aircraft, and a respective characteristic feature position of said specific characteristic feature is a position of said nose portion of the aircraft.

Identifying the nose portion of the aircraft has potential advantages. Firstly, it allows for an earlier detection as the aircraft approaches the stand. Secondly, the nose portion is relatively easy to identify as compared to some other aircraft features. Moreover, the nose portion does in itself constitute a marker defining a limit of an extension of the aircraft in the sensing area.

According to some embodiments, the one or more estimated exterior surface positions on the aircraft comprises an estimated exterior surface position of a tail portion of the aircraft.

Targeting the tail portion may be of importance, as the aircraft typically enters the stand area in a straight-forward fashion substantially aligned with a predefined lead-in line, sometimes referred to as a center line. This often means that the aircraft tail portion will be most exposed to collisions from other aircrafts, e.g. on the taxiway.

According to some embodiments, the received aircraft dimension data includes a length of the aircraft, and the controller is being configured to calculate said estimated exterior surface position on the tail portion of the aircraft by adding said length of the aircraft to said position of the nose portion of the aircraft in a direction out from said position of the nose portion being parallel to an estimated direction of a longitudinal extension of the aircraft.

This provides a relatively robust and fast way of calculating an estimated exterior surface position on the tail portion of the aircraft. The longitudinal extension of the aircraft is essentially defined by the longitudinal extension of the aircraft fuselage (i.e. the aircraft main body). In the present example, the estimated direction of the longitudinal extension of the aircraft may be taken to be a direction of the lean-in line. This estimation may often be accurate enough, as aircrafts which approach the stand area at angles deviating considerably from the lead-in line, are likely to be stopped from approaching already at an early stage of approach for safety reasons.

Alternatively, the longitudinal extension of the aircraft may be determined by the airport stand arrangement. According to some embodiments, the estimated direction of the longitudinal extension of the aircraft is calculated based on at least two from said two or more characteristic feature positions.

The estimated direction of the longitudinal extension of the aircraft is here calculated by relying on two known positions on the aircraft. In case the two known position are symmetrically located on the aircraft, such as e.g. positions of two aircraft engines located on either side of the fuselage, the estimated direction of the longitudinal extension of the aircraft may be calculated by simple geometry. A more robust estimation may be obtained for example by utilizing more than two known positions of the aircraft (e.g. three or more characteristic feature positions), and, alternatively or additionally, to make use of airport dimension data for easier determination of further geometrical data points of the aircraft.

According to some embodiments, the controller being configured to compare said one or more estimated exterior surface positions with one or more coordinates of the stand area comprises:

the controller being configured to compare said estimated exterior surface position of a tail portion of the aircraft with a longitudinal extension of said stand area.

This embodiment provides a fast and reliable way of determining if the tail portion is protruding from the stand area. The term "longitudinal extension of the stand area" should be interpreted as the extension of the stand area along the center line.

According to some embodiments, at least one estimated exterior surface position on the aircraft is defined on a wing tip of the aircraft.

Monitoring the wing tips may be beneficial for example where aircrafts maneuvering to/from neighboring stands may come too close to each other. Respective airport stand arrangements located at neighboring stands may monitor the position of the wing tips of the respective aircraft and, in response to a wing tip position being determined to be outside the stand area, output an aircraft parking alert signal. Said parking alert signal could be transmitted to a neighboring stand so as to warn personnel at that stand that a neighboring aircraft may be too close to the stand.

According to some embodiments, the controller is further configured to:

in response to said one or more exterior surface positions being determined to be inside of said stand area:

output a stand area clearance signal.

Outputting a stand area clearance signal allows for continuously declaring that the aircraft is parked safely. The stand area clearance signal may be transmitted intermittently, e.g. at a predefined repetition frequency.

The controller may be configured to transmit said stand area clearance signal to one or more from:

neighboring aircrafts in a vicinity of the sensing area, an airport operational database, air traffic control, and receiving units carried by stand personnel.

Neighboring aircrafts may be aircrafts at, or approaching/leaving, neighboring stands. Neighboring aircrafts may alternatively be aircrafts just passing in a vicinity of the stand, such as e.g. taxying aircrafts passing the stand at a neighboring taxiway.

According to some embodiments, the controller being configured to output the aircraft parking alert signal, comprises:

the controller being configured to transmit said aircraft parking alert signal to one or more from:

neighboring aircrafts in a vicinity of the sensing area, an airport operational database, ground control, and receiving units carried by stand personnel.

Alternatively, or additionally, for embodiments of the airport stand arrangement having aircraft docking functionality, such as e.g. aircraft docking systems, the controller may be further configured to output the aircraft parking alert signal to the display for informing the pilot of the aircraft that the aircraft is not safely parked at the parking position. This may be performed intermittently, e.g. at a predefined repetition frequency, or, alternatively, when the pilot indicates that he/she has parked the aircraft at the stop position.

According to a second aspect there is provided a method implemented in an airport stand arrangement, wherein said stand arrangement comprises a remote sensing system configured to detect the aircraft within a sensing area, wherein said sensing area includes said stand area of a stand, said method comprising:

receiving, from the remote sensing system, sensor data pertaining to an aircraft detected within the sensing area, determining, based on said received sensor data, one or more estimated exterior surface positions on the aircraft, wherein each estimated exterior surface position is an estimated position of an associated real exterior surface position on the aircraft, wherein said real exterior surface position defines a limit of an extension of said aircraft in the sensing area, comparing said one or more estimated exterior surface positions with one or more coordinates of the stand area to determine if at least one from said one or more estimated exterior surface positions is outside of said stand area, and in response to at least one from said one or more estimated exterior surface positions being determined to be outside of said stand area:

outputting an aircraft parking alert signal.

According to some embodiments, determining one or more estimated exterior surface positions on the aircraft comprises:

identifying one or more characteristic features of the aircraft, determining, for each characteristic feature of said one or more characteristic features, a respective characteristic feature position, so as to define, on the aircraft, one or more characteristic feature positions, receiving aircraft dimension data pertaining to the aircraft, or to an aircraft which is expected to arrive at the stand, and calculating said one or more estimated exterior surface positions on the aircraft based on said one or more characteristic feature positions and said aircraft dimension data.

According to some embodiments, a specific characteristic feature of said one or more characteristic features of the aircraft is a nose portion of the aircraft, a respective characteristic feature position of said specific characteristic feature is a position of said nose portion of the aircraft, said one or more estimated exterior surface positions on the aircraft comprises an estimated exterior surface position of a tail portion of the aircraft, said received aircraft dimension data includes a length of the aircraft, and the step of calculating said one or more estimated exterior surface positions on the aircraft comprises:

calculating said estimated exterior surface position on the tail portion of the aircraft by adding said length of the aircraft to said position of the nose portion of the aircraft in a direction being parallel to a longitudinal extension of the aircraft.

Effects and features of the second and third aspects are largely analogous to those described above in connection with the first aspect. Embodiments mentioned in relation to the first aspect are largely compatible with the second aspect and third aspects. It is further noted that the inventive concepts relate to all possible combinations of features unless explicitly stated otherwise.

According to a third aspect there is provided a computer-readable medium comprising computer code instructions which when executed by a device having processing capability are adapted to perform the method according to the second aspect.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting.

It must be noted that, as used in the specification and the appended claim, the articles "a", "an", "the", and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTIONS OF THE DRAWINGS

The invention will by way of example be described in more detail with reference to the appended schematic drawings, which show presently preferred embodiments of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
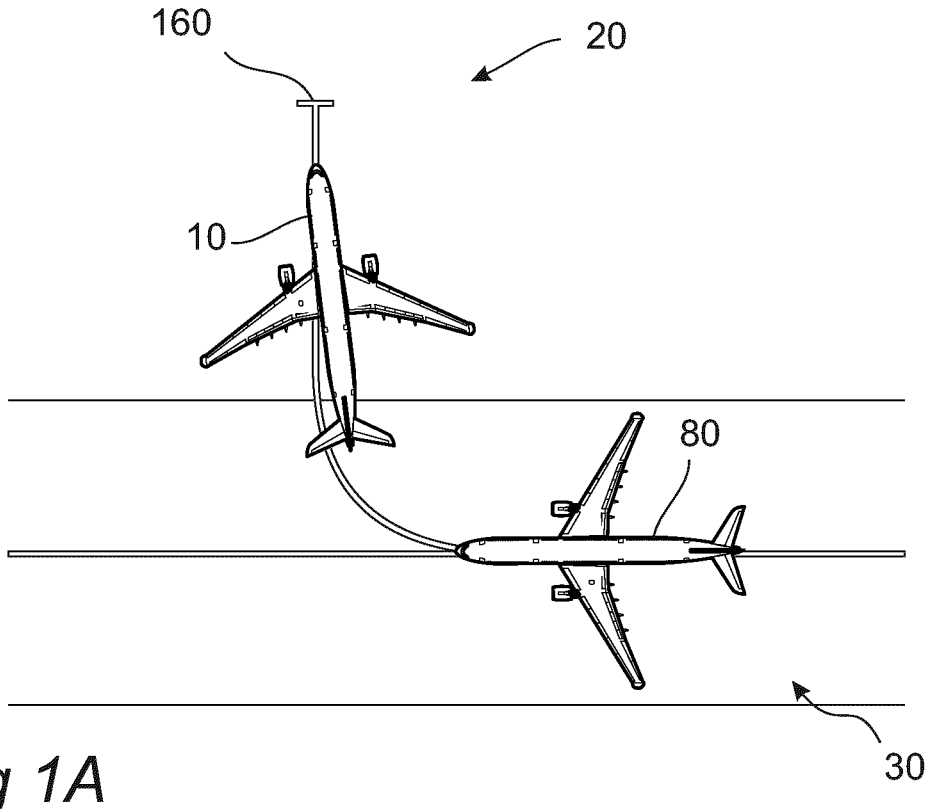
FIGS. 1A and 1B shows a top view of an airport stand, a neighboring taxiway and two aircrafts.
Figure 1B:
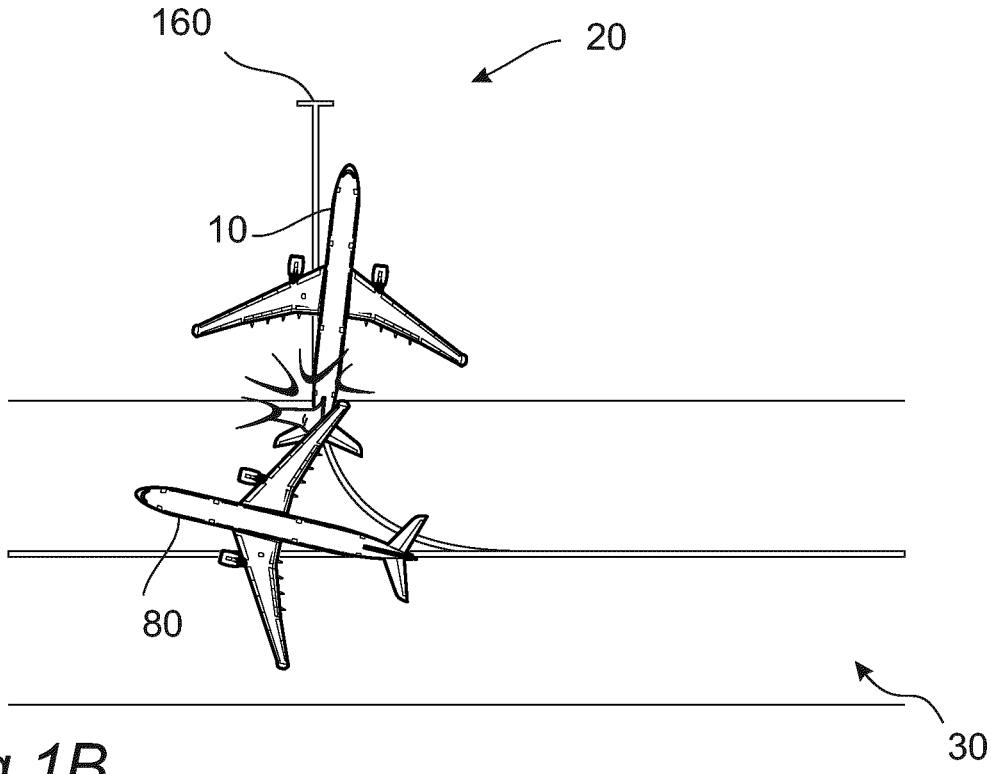

FIGS. 1A and B show a situation which may occur, and actually does sometimes occur, at an airport. As shown in FIG. 1A, an aircraft 10 has parked at a stand 20. However, for some reason, the pilot has not approached all the way to the stop position 160. This has resulted in parts of the aircraft protruding out from the stand into the neighboring taxiway 30. However, as the airport traffic control has obtained the information that the aircraft 10 is successfully parked at the stand 20, another aircraft 80 has been given a clearance to pass the stand 20 at the taxiway 30. The pilot of the aircraft 80 is not aware of the protruding tail portion of the aircraft 10, and can also not see the problem from his position in the cockpit. Moreover, he/she has indeed obtained a clearance to pass. As illustrated in FIG. 1B, this leads to a collision, where the right wing of aircraft 80 collides with the rudder of aircraft 10, a collision which may induce severe risks for passengers and ground crew as well as vast material damage to the involved aircrafts.

In order to avoid the above described situations, here is disclosed an airport stand arrangement.

Figure 2:
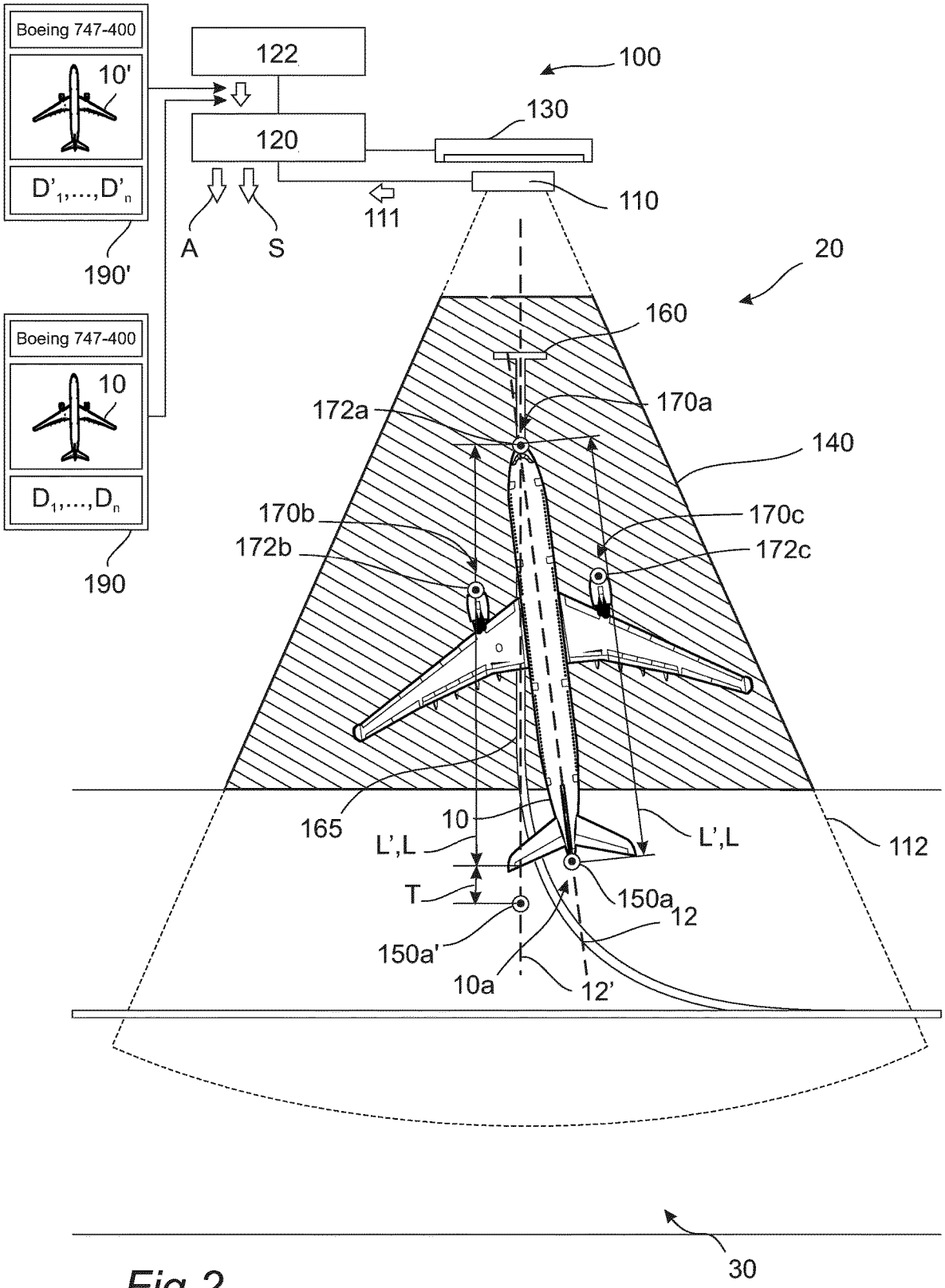
FIG. 2 shows a top view of an airport stand arrangement according to an embodiment of the present disclosure.

FIG. 2 illustrates a first example embodiment: the airport stand arrangement 100. The airport stand arrangement 100 comprises a remote sensing system 110 configured to detect an aircraft 10 within a sensing area 112, wherein said sensing area 112 includes a stand area 140 of a stand 20. The sensing area 112 covers at least parts of the stand 20, and here also parts of a neighboring taxiway 20. The remote sensing system 110 includes one or more from: a radar-based system, a laser-based system, and an imaging system. The remote sensing system may for example comprise a laser-based remote sensing system configured to scan the sensing area 112.

The airport stand arrangement 100 further comprises a display 130, and the arrangement 100 is further configured, based on data from said remote sensing system 110, to detect and track the aircraft 10 for parking at a parking position 160 within said stand area 140. The airport stand arrangement 100 is further configured, based on said detection and tracking of the aircraft 10, to provide pilot maneuvering guidance information on said display 130 for aiding a pilot of the aircraft 10 in maneuvering the aircraft towards said parking position 160. Thus, the airport stand arrangement 100 has the functionality of an automatic docking system.

The airport stand arrangement 100 further comprises a controller 120 configured to determine, based on sensor data 111 received from said remote sensing system 110, one or more estimated exterior surface positions (in the example: one estimated exterior surface position 150*a*') on the aircraft 10, wherein each estimated exterior surface position is an estimated position of an associated real exterior surface position on the aircraft 10 (in the example: associated real exterior surface position 150*a*). As can be seen in FIG. 2, for the example embodiment, the estimated exterior surface position 150*a*' is defined on a tail portion 10*a* of the aircraft 10. The real exterior surface position 150*a* defines a limit of an extension of said aircraft in the sensing area 112. The estimated exterior surface position 150*a*' may differ from the real exterior surface position 150*a* (see FIG. 2).

The controller 120 is further configured to compare said one or more estimated exterior surface positions 150*a*' with one or more coordinates of the stand area 140 to determine if at least one from said one or more estimated exterior surface positions 150*a*' is outside of said stand area 140.

Finally, the controller 120 is configured to output an aircraft parking alert signal A in response to at least one from said one or more estimated exterior surface positions 150*a*' being determined to be outside of said stand area 140. For the example embodiment described hereinabove, there is only one estimated exterior surface position, namely the estimated position 150*a*' of the tail portion 10*a*.

The aircraft parking alert signal A may be used in different ways. For the example embodiment, the controller 120 is configured to transmit, using a transmitter (not shown), the aircraft parking alert signal A to neighboring aircrafts in a vicinity of the sensing area 112, an airport operational database, air traffic control, and receiving units carried by stand personnel. As realized by the person skilled in the art, the transmission of the alert signal A opens up for many ways of reducing the risk of collisions. It further allows for improving airport ground traffic efficiency.

The controller 120 is further configured to, in response to said one or more estimated exterior surface positions 150*a*' being determined to be inside of said stand area 140: output a stand area clearance signal S. The controller 120 may be configured to transmit said stand area clearance signal S to one or more from: neighboring aircrafts in the vicinity of the sensing area, an airport operational database, air traffic control, and receiving units carried by stand personnel.

There are many alternative ways of how to determine the one or more estimated exterior surface positions on the aircraft. One way is disclosed hereinbelow for the airport stand arrangement 100:

The controller 120 is first configured to identify one or more characteristic features 170*a-c* of the aircraft 10. The controller receives sensor data 111 from the remote sensing system 110, and analyses said sensing data 111. In case an object is detected, the controller 120 is configured to search the sensing data 111, e.g. by pattern recognition techniques, to identify characteristic features of the aircraft. The characteristic features are predetermined and are associated with a specific characteristic pattern in the sensing data 111. One such characteristic feature is the nose portion 170*a* of the aircraft 10. Other characteristic features are e.g. the aircraft engines 170*b*, 170*c* and the front shape of the wings etc.

The controller 120 is then configured to determine, for each characteristic feature of said one or more characteristic features, a respective characteristic feature position, so as to define, on the aircraft 10, one or more characteristic feature positions 172*a-c*. Thus, the method allows determining spatial coordinates pertaining to specific aircraft features.

The controller 120 is then configured to receive aircraft dimension data 190 pertaining to the aircraft 10, or to an aircraft 10' which is expected to arrive at the stand 20. The aircraft dimension data 190 and 190' are alternatives to each other and will be discussed more in detail, later. The controller 120 is then configured to calculate said one or more estimated exterior surface positions (in the example: the estimated position of the tail portion 150*a*') on the aircraft 10 based on said one or more characteristic feature positions 172*a-c* and said aircraft dimension data 190,190'. In the example embodiment, the aircraft dimension data 190' includes a length L' of the aircraft 10' expected to arrive at the stand 20, and the aircraft dimension data 190 includes a length L of the aircraft 10 in the stand 20. There is an important distinction to be made between the two aircrafts 10 and 10' referred to herein. The length may namely be determined either by estimating the length L based on sensing data acquired directly from the aircraft 10 present in the sensing area 112, or from information conveyed to the controller 110 from elsewhere of a length L' of an expected aircraft 10'. According to the first alternative, the aircraft 10 present in the sensing area 112 is sensed by the remote sensing system 110. Then, based on sensor data 111 received from said sensing system 110, the length L may be inferred, either directly (e.g. by analyzing a characteristic feature of a tail portion 10*a* of the aircraft 10) or indirectly. As remote sensing systems may be less accurate in detecting characteristic features at the tail portion 10*a*, the indirect method may be beneficial. The aircraft stand arrangement 100 may be configured to determine two or more characteristic features of the aircraft 170*a-c*, and associated two or more characteristic feature positions 172*a-c*. One known approach is to determine the position 172*a* of the nose portion 170*a*, and the positions 172*b*,172*c* of engines 170*b*,170*c* carried by the aircraft wings. The controller 120 may be configured to compare the two or more characteristic feature positions 172*a-c* with an aircraft dimension database 122 which includes aircraft dimension data for a plurality of aircraft types and/or models, and in response to a match being found between the two or more characteristic feature positions 172*a-c* and specific aircraft dimension data 190 from the aircraft dimension data in the database, retrieve, from that specific aircraft dimension data, an aircraft length L.

The airport stand arrangement 100 now has access to at least one reference position of an aircraft characteristic feature, for example the characteristic feature position 172*a* of the nose portion 170*a* of the aircraft 10. The arrangement 100 also has access to an estimated L, or assumed L', length of the aircraft 10. As a third piece of information, the controller 120 is configured to determine an estimated direction 12' of a longitudinal extension of the aircraft 10. For the airport stand arrangement 100 illustrated in FIG. 2, the direction is estimated based on an assumed aircraft angular position with respect to the stand 20. As an aircraft is maneuvered, by the pilot or by towing vehicles, so as to follow a predetermined path, this seemingly crude approach may in reality be sufficient for the airport stand arrangement. In the stand area 20, the aircraft 10 will, at least when being in a vicinity of the stop position 160, be relatively well aligned with the center line 165. Thus, an estimated direction 12' of the longitudinal extension of the aircraft 10 may be assumed to be parallel with the center line 165. The controller 110 is then configured to calculate the estimated exterior surface position 150*a*' on the tail portion 10*a* of the aircraft 10 by adding the (retrieved) length L of the aircraft to said position 172 of the nose portion 170*a* of the aircraft in a direction out from said position 172*a* of the nose portion 170*a* being parallel to the estimated direction 12' of a longitudinal extension of the aircraft 10. The relatively crude approximation of the aircraft angular position with respect to the stand 20, is illustrated in FIG. 2, where the estimated exterior surface position 150*a*' on the tail portion 10*a* of the aircraft 10 appears at some distance to the left of its real counterpart, the real exterior surface position 150*a*. One way of taking the potential inaccuracy in the estimation into account, is to add a safety distance T to the estimated position value. This is also illustrated in FIG. 2, where the estimated position 150*a*' of the tail portion 10*a* will end up at some distance from the real position 150*a* of the tail portion 10*a*.

Figure 3:
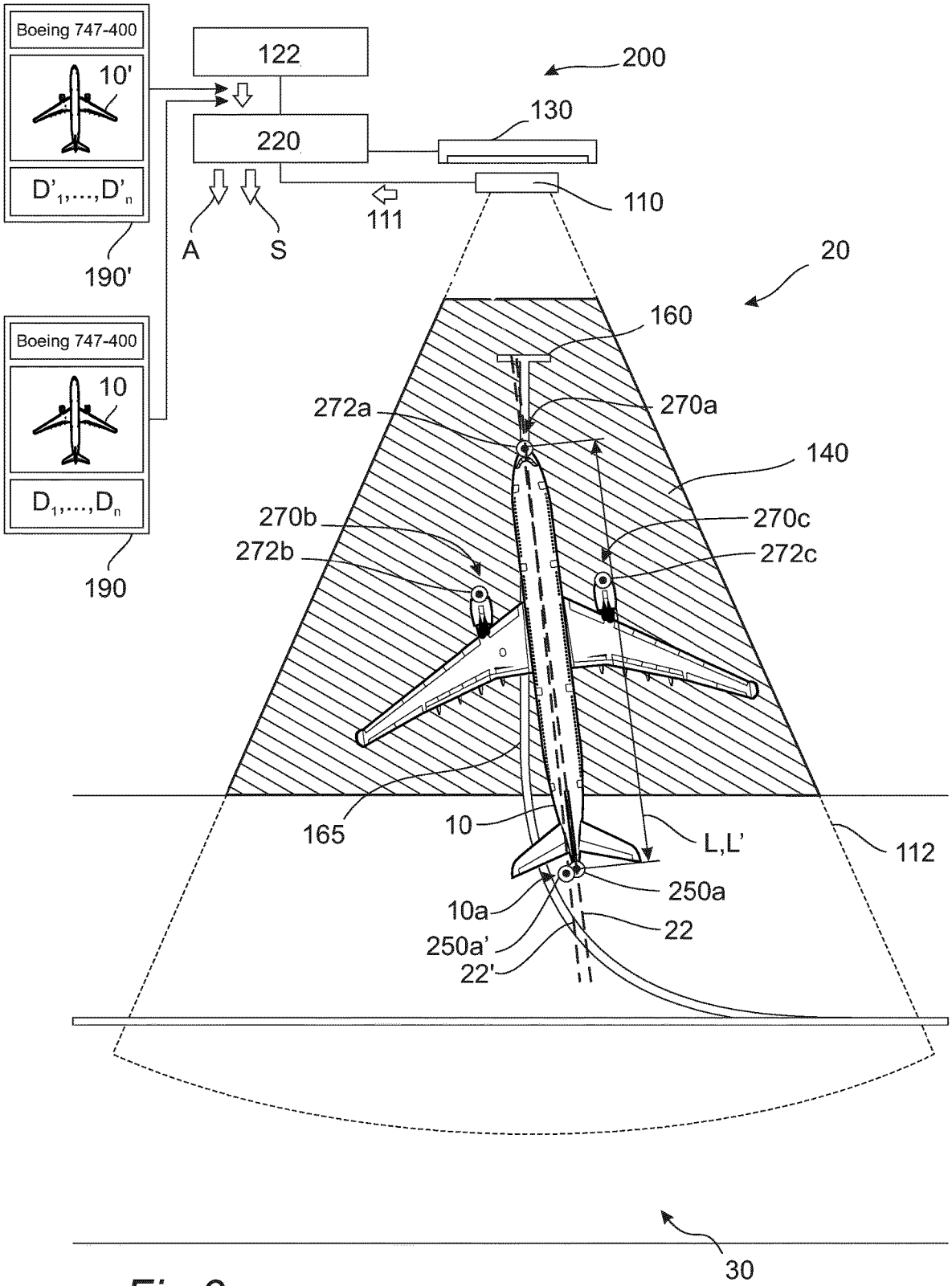
FIG. 3 shows a top view of an airport stand arrangement according to another embodiment of the present disclosure.

FIG. 3 illustrates an airport stand arrangement 200 according to an alternative embodiment. The airport stand arrangement 200 shares structural features with the airport stand arrangement 100, but differs in the fact that the controller 220 is here configured to identify two or more characteristic features of the aircraft 270*a-c*, associated two or more characteristic feature positions 272*a-c*, and calculate the estimated direction 22' of the longitudinal extension of the aircraft based on at least two from said two or more characteristic feature positions 272*a-c*. Thus, instead of assuming an aircraft angular position with respect to the stand 20, the longitudinal extension of the aircraft 10 is determined by the airport stand arrangement 200. The estimated direction 22' of the longitudinal extension of the aircraft 10 may be calculated by comparing the two or more characteristic feature positions 272*a-c* of the aircraft with coordinates of the stand area 140, or coordinates of the center line 165. The aircraft length may be determined either for the aircraft 10 in the stand 20 (the length L) or for the aircraft 10' expected to arrive at the stand 20 (the length L'). The controller 220 may then be configured to calculate the estimated exterior surface position 250*a*' on the tail portion 10*a* of the aircraft 10 by adding the length L,L' to the position 272*a* of the nose portion 270*a* of the aircraft in a direction out from the position 272*a* of the nose portion 270*a* being parallel to an estimated direction 22') of a longitudinal extension of the aircraft. As illustrated in FIG. 3, this may provide an increased accuracy in estimated position 250*a*' of the tail portion 10*a*.

Herein has hitherto been discussed the tail portion of the aircraft. However, also other parts of aircrafts may be involved in accidents if they unknowingly protrude out from the stand area 120.

Figure 4:
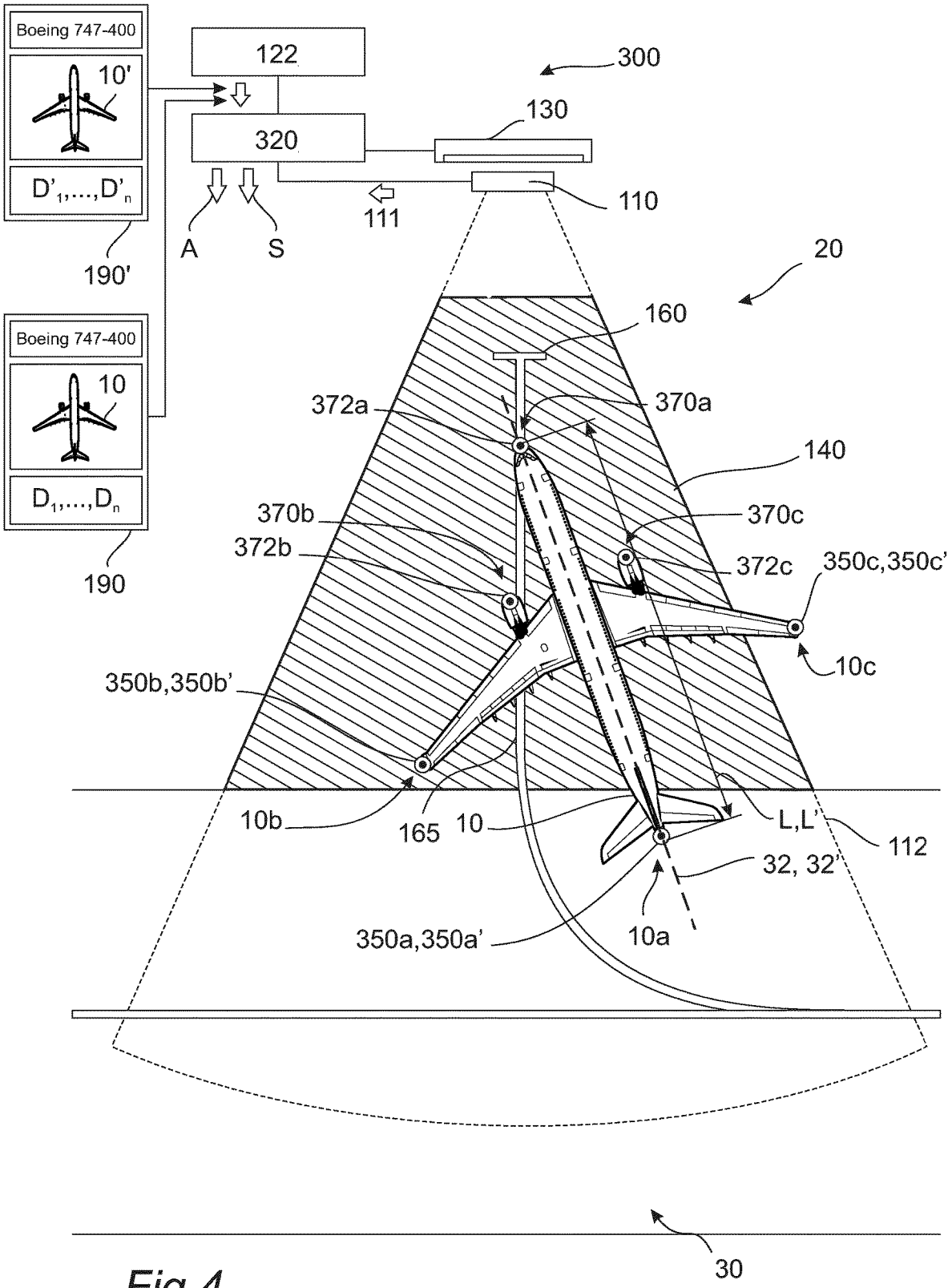
FIG. 4 shows a top view of an airport stand arrangement according to yet another embodiment of the present disclosure.

FIG. 4 illustrates such a scenario, and at the same time illustrates an airport stand arrangement 300 according to another example embodiment. The airport stand arrangement 300 shares structural features with the airport stand arrangement 100 and 200, but differs in the fact that the controller 320 is here configured to determine arbitrary estimated exterior surface positions along the boundary of the aircraft 10.

Firstly, we note that the aircraft 10 is now standing in the stand area 140, with both its tail portion 10*b* and a right wing portion 10*c* protruding out therefrom. Whereas the airport stand arrangements 100 and 200 are configured to estimate the position of the tail portion 10*a*, said arrangements 100,200 may not be configured to detect the position of the left wing portion 10*c*.

However, in the airport stand arrangement 300, the controller 320 is configured, after having identified the characteristic features 370*a-c* and determined associated positions 372*a-c* thereof, to compare said two or more characteristic feature positions 372*a-c* with an aircraft dimension database 122 which includes aircraft dimension data for a plurality of aircraft types and/or models, and in response to a match being found between the two or more characteristic feature positions 372*a-c* and specific aircraft dimension data 190, 190' from the aircraft dimension data in the database 122: determine said one or more estimated exterior surface positions 350*a'*-c' on the aircraft 10 based on said two or more characteristic feature positions 372*a-c* and said specific aircraft dimension data 190,190'.

Thus, for the airport stand arrangement 300, the two or more reference positions of the aircraft (i.e. the characteristic feature positions 372*a-c*) are not only used to determine, or merely retrieve, a length of the aircraft, but alternatively or additionally to infer other dimensions pertaining to the aircraft 10. Such dimensions may be, but are not limited to: aircraft length, wing span, height, wing area, distance between engines, wheelbase etc. Given sufficient input data from the aircraft dimension database 122, the controller 320 may be configured to determine any position along the aircraft boundary, including positions of the wing tip portions 10*b*,10*c*.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. An airport stand arrangement comprising:

a remote sensing system configured to detect an aircraft within a sensing area, wherein said sensing area includes a stand area of a stand, and a controller configured to:

determine, based on sensor data received from said remote sensing system, one or more estimated exterior surface positions on the aircraft, wherein each estimated exterior surface position is an estimated position of an associated real exterior surface position on the aircraft, wherein said real exterior surface position defines a limit of an extension of said aircraft in the sensing area, and wherein the controller being configured to determine said one or more estimated exterior surface positions of the aircraft, comprises that the controller being configured to:

identify one or more characteristic features of the aircraft, wherein a specific characteristic feature of said one or more characteristic features of the aircraft is a nose portion of the aircraft, determine, for each characteristic feature of said one or more characteristic features, a respective characteristic feature position, so as to define, on the aircraft, one or more characteristic feature positions, wherein a respective characteristic feature position of said specific characteristic feature is a position of said nose portion of the aircraft, receive aircraft dimension data pertaining to the aircraft, and calculate said one or more estimated exterior surface positions on the aircraft based on said one or more characteristic feature positions and said aircraft dimension data, wherein said one or more estimated exterior surface positions on the aircraft comprises an estimated exterior surface position of a tail portion of the aircraft, wherein the controller is further configured to:

compare said one or more estimated exterior surface positions with one or more coordinates of the stand area to determine if at least one from said one or more estimated exterior surface positions is outside of said stand area, and in response to at least one from said one or more estimated exterior surface positions being determined to be outside of said stand area:

output an aircraft parking alert signal.

2. The airport stand arrangement according to claim 1, wherein said remote sensing system includes one or more from: a radar-based system, a laser-based system, and an imaging system.

3. The airport stand arrangement according to claim 1, wherein the airport stand arrangement further comprises a display, and wherein the airport stand arrangement is further configured, based on data from said remote sensing system, to detect and track the aircraft for parking at a parking position within said stand area, and configured, based on said detection and tracking of the aircraft, to provide pilot maneuvering guidance information on said display for aiding a pilot of the aircraft in maneuvering the aircraft towards said parking position.

4. The airport stand arrangement according to claim 1 wherein said received aircraft dimension data includes a length of the aircraft, and wherein the controller is being configured to calculate said estimated exterior surface position on the tail portion of the aircraft by adding said length of the aircraft to said position of the nose portion of the aircraft in a direction out from said position of the nose portion being parallel to an estimated direction of a longitudinal extension of the aircraft.

5. The airport stand arrangement according to claim 1, wherein said one or more characteristic features of the aircraft comprises two or more characteristic features of the aircraft, and wherein said one or more characteristic feature positions comprises two or more characteristic feature positions.

6. The airport stand arrangement according to claim 5, wherein said estimated direction of the longitudinal extension of the aircraft is calculated based on at least two from said two or more characteristic feature positions.

7. The airport stand arrangement according to claim 5, wherein the controller being configured to determine one or more estimated exterior surface positions on the aircraft, comprises:

the controller being configured to:

compare said two or more characteristic feature positions with an aircraft dimension database which includes aircraft dimension data for a plurality of aircraft types and/or models, and in response to a match being found between said two or more characteristic feature positions and specific aircraft dimension data from the aircraft dimension data in the database:

determine said one or more estimated exterior surface positions on the aircraft based on said two or more characteristic feature positions and said specific aircraft dimension data.

8. The airport stand arrangement according to claim 1, wherein the controller is further configured to:

in response to said one or more estimated exterior surface positions being determined to be inside of said stand area:

output a stand area clearance signal.

9. The airport stand arrangement according to claim 1, wherein the controller being configured to output the aircraft parking alert signal, comprises:

the controller being configured to transmit said aircraft parking alert signal to one or more from:

neighboring aircrafts in a vicinity of the sensing area, an airport operational database, ground control, and receiving units carried by stand personnel.

10. A method implemented in an airport stand arrangement, wherein said stand arrangement comprises a remote sensing system configured to detect the aircraft within a sensing area, wherein said sensing area includes said stand area of a stand, said method comprising:

receiving, from the remote sensing system, sensor data pertaining to an aircraft detected within the sensing area, determining, based on said received sensor data, one or more estimated exterior surface positions on the aircraft, wherein each estimated exterior surface position is an estimated position of an associated real exterior surface position on the aircraft, wherein said real exterior surface position defines a limit of an extension of said aircraft in the sensing area, wherein determining one or more estimated exterior surface positions on the aircraft comprises:

identifying one or more characteristic features of the aircraft, wherein a specific characteristic feature of said one or more characteristic features of the aircraft is a nose portion of the aircraft, determining, for each characteristic feature of said one or more characteristic features, a respective characteristic feature position, so as to define, on the aircraft, one or more characteristic feature positions, wherein a respective characteristic feature position of said specific characteristic feature is a position of said nose portion of the aircraft, receiving aircraft dimension data pertaining to the aircraft, and calculating said one or more estimated exterior surface positions on the aircraft based on said one or more characteristic feature positions and said aircraft dimension data, wherein said one or more estimated exterior surface positions on the aircraft comprises an estimated exterior surface position of a tail portion of the aircraft comparing said one or more estimated exterior surface positions with one or more coordinates of the stand area to determine if at least one from said one or more estimated exterior surface positions is outside of said stand area and in response to at least one from said one or more estimated exterior surface positions (being determined to be outside of said stand area:

outputting an aircraft parking alert signal.

11. The method according to claim 10, wherein said received aircraft dimension data includes a length of the aircraft, and wherein the step of calculating said one or more estimated exterior surface positions on the aircraft comprises:

calculating said estimated exterior surface position on the tail portion of the aircraft by adding said length of the aircraft to said position of the nose portion of the aircraft in a direction out from said position of the nose portion being parallel to an estimated direction of a longitudinal extension of the aircraft.

12. A non-transitory computer-readable medium comprising computer code instructions which when executed by a device having processing capability are adapted to perform the method according to claim 10.

* * * * *